US010142735B2

(12) United States Patent
Jan

(10) Patent No.: US 10,142,735 B2
(45) Date of Patent: Nov. 27, 2018

(54) DUAL MODE HEADPHONE AND METHOD THEREFOR

(71) Applicant: Jonathan Jan, Culver City, CA (US)

(72) Inventor: Jonathan Jan, Culver City, CA (US)

( * ) Notice: Subject to any disclaimer, the term of this patent is extended or adjusted under 35 U.S.C. 154(b) by 0 days.

(21) Appl. No.: 15/435,598

(22) Filed: Feb. 17, 2017

(65) Prior Publication Data

US 2018/0098153 A1 Apr. 5, 2018

Related U.S. Application Data

(60) Provisional application No. 62/404,092, filed on Oct. 4, 2016.

(51) Int. Cl.

| | |
|---|---|
| ***H04R 25/00*** | (2006.01) |
| ***H04R 5/033*** | (2006.01) |
| ***H04R 1/10*** | (2006.01) |
| *H04R 1/28* | (2006.01) |
| *H04R 17/00* | (2006.01) |

(52) U.S. Cl.

CPC ..... *H04R 5/0335* (2013.01); *H04R 1/1075* (2013.01); *H04R 1/1025* (2013.01); *H04R 1/1041* (2013.01); *H04R 1/1083* (2013.01); *H04R 1/2811* (2013.01); *H04R 17/00* (2013.01); *H04R 25/656* (2013.01); *H04R 2420/07* (2013.01); *H04R 2460/13* (2013.01)

(58) Field of Classification Search

CPC .. H04R 5/0335; H04R 1/1075; H04R 17/005; H04R 1/1025; H04R 1/1041; H04R 1/101083; H04R 1/2811; H04R 25/656; H04R 2420/07; H04R 2460/13

USPC ..... 381/151

See application file for complete search history.

(56) References Cited

U.S. PATENT DOCUMENTS

| | | | | |
|---|---|---|---|---|
| 4,821,323 | A * | 4/1989 | Papiernik | H04R 1/1066 381/151 |
| 8,699,742 | B2 * | 4/2014 | Heiman | H04S 7/301 381/151 |
| 9,601,682 | B2 * | 3/2017 | Ishii | H01L 41/053 |
| 9,788,097 | B2 * | 10/2017 | Bullen | H04R 1/1041 |
| 9,860,647 | B2 * | 1/2018 | Wen | H04R 17/00 |
| 9,973,857 | B2 * | 5/2018 | Tokuhisa | H04R 1/06 |
| 2005/0201569 | A1 * | 9/2005 | Kuraoka | H04M 1/0289 381/74 |
| 2008/0112581 | A1 * | 5/2008 | Kim | H04R 1/1075 381/151 |
| 2011/0170723 | A1 * | 7/2011 | Ryann | A44C 7/00 381/322 |
| 2011/0301729 | A1 * | 12/2011 | Heiman | H04S 7/301 700/94 |
| 2013/0136279 | A1 * | 5/2013 | Brown | H04R 1/10 381/151 |

(Continued)

*Primary Examiner* — Phylesha Dabney

(74) *Attorney, Agent, or Firm* — Weiss & Moy, P.C.; Jeffrey D. Moy

(57) ABSTRACT

A dual mode headphone has a band positioning the dual mode headphone on one of a head or neck of a user. A pair of first housings is provided wherein one of the first housings is formed on each end of the band. A dual mode headphone circuit is provided and has a dual-output acoustic transducer module positioned in each of the pair of first housings. The dual-output acoustic transducer module allowing for both air conduction and bone conduction of sound waves.

9 Claims, 5 Drawing Sheets

(56) References Cited

U.S. PATENT DOCUMENTS

| | | | | |
|---|---|---|---|---|
| 2013/0259271 | A1* | 10/2013 | Miyoshi | H04R 15/00 381/151 |
| 2016/0277823 | A1* | 9/2016 | Huang | H04R 1/1016 |
| 2017/0223445 | A1* | 8/2017 | Bullen | H04R 1/1016 |
| 2017/0318379 | A1* | 11/2017 | Bullen | H04R 1/1016 |

* cited by examiner

DUAL MODE HEADPHONE AND METHOD THEREFOR

RELATED APPLICATIONS

The present patent application claims the benefit of U.S. Provisional Application No. 62/404,092, filed Oct. 4, 2016, entitled "DUAL-OUTPUT ACOUSTIC TRANSDUCER AND METHOD THEREFOR", in the name of the same inventor and which is incorporated herein by reference in its entirety.

TECHNICAL FIELD

The present application generally relates to an audio wave delivery system, and, more particularly, to an audio wave delivery system that incorporates both a loudspeaker and a piezoelectric bone-conductive transducer in one integrated module.

BACKGROUND

Headphones are a pair of small listening devices that are designed to be worn on or around the head over the ears of a user. Conventional audio headphones incorporate magnetic-coil loudspeakers, which convert electrical signals into audio signals via air pressure waves. The acoustic waves cause the eardrum membrane to vibrate, which sends the audio signals to the auditory nerves.

Many headphones suffer from sound quality issues. These issues may be exacerbated due to outside noise. Unfortunately, many people have a tendency to increase the volume of the headphones to compensate for the sound quality issues and/or to drown out the outside noise.

With the advent of portable music players, earbuds became a popular alternative to headphones. Earbuds are generally comprised of small speakers which may be inserted into the user's ear canal. Earbuds are typically less expensive than headphones, much lighter and far less bulky. Unfortunately, earbuds deliver inferior sound quality, especially when it comes to bass tones. Earbuds don't filter out external noise very well, so earbud-wearers tend to crank up the volume which may damage the user's hearing.

First generation "hearing aids" are similar to earbuds in that they generally require insertion of the loudspeakers into the ear canals and boosts the dB of the audio signal. Hearing aids are uncomfortable to wear and can potentially further damage the delicate inner-ear components.

Recently, bone-conductive technology has been utilized in both headphones and hearing aids. Bone conduction transmits sound waves through the bones in the user's skull. The vibrations reach the cochlea, or inner ear, which converts them to electrical impulses that travel the auditory nerve to the brain. This is generally accomplished by using a piezoelectric ceramic transducer. To accomplish efficient audio signal transfer, the bone-conductive transducer has to be in direct contact with the skull bone. The headphone/hearing aid is generally installed either in-canal or behind-ear and requires tedious adjustments by an audiologist. Bone-conductive headphones and hearing aids generally require frequent battery replacement. Also, since the ear passage remains unblocked, headphone users generally are able to hear external noises around them.

Therefore, it would be desirable to provide an apparatus and method that overcome the above problems.

SUMMARY OF THE INVENTION

In accordance with one embodiment, a dual mode headphone is disclosed. The dual mode headphone has a band positioning the dual mode headphone on one of a head or neck of a user. A pair of first housings is provided wherein one of the first housings is formed on each end of the band. A dual mode headphone circuit is provided. The dual mode headphone circuit has a dual-output acoustic transducer module positioned in each of the pair of first housings. The dual-output acoustic transducer module allowing for both air conduction and bone conduction of sound waves.

In accordance with one embodiment, a dual mode headphone is disclosed. The dual mode headphone has a band positioning the dual mode headphone on one of a head or neck of a user. A dual mode headphone circuit is provided and has a dual-output acoustic transducer module positioned on opposing ends of the band. The dual-output acoustic transducer module allowing for both air conduction and bone conduction of sound waves.

In accordance with one embodiment, a dual mode headphone is disclosed. The dual mode headphone has a band positioning the dual mode headphone on one of a head or neck of a user. A pair of first housings is provided, wherein one of the first housings is formed on each end of the band. A dual mode headphone circuit is provided. The dual mode headphone circuit has a dual-output acoustic transducer module positioned in each of the pair of first housings, the dual-output acoustic transducer module allowing for both air conduction and bone conduction of sound waves. An amplifier is coupled to the dual-output acoustic transducer module. A microphone is coupled to the amplifier. A transmitter/receiver is coupled to the amplifier. A control unit is coupled to the dual-output acoustic transducer module.

BRIEF DESCRIPTION OF THE DRAWINGS

The present application is further detailed with respect to the following drawings. These figures are not intended to limit the scope of the present application but rather illustrate certain attributes thereof.

DESCRIPTION OF THE APPLICATION

Figure 1:
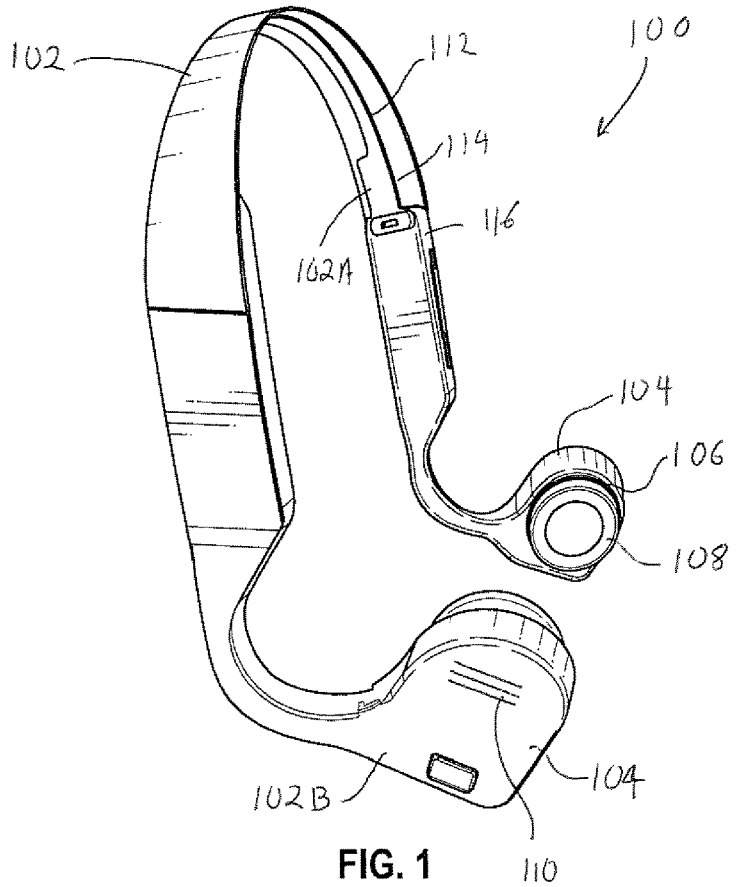
FIG. 1 is an perspective view of a dual mode headphone in accordance with one aspect of the present application.
Figure 2:
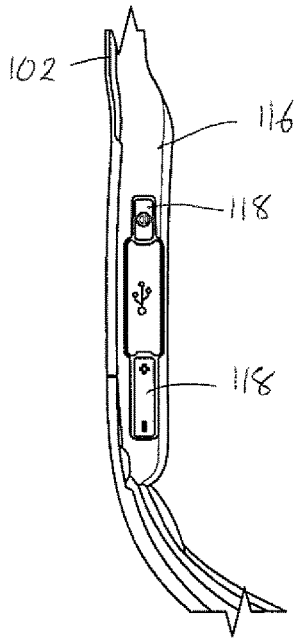
FIG. 2 is a magnified view of an interior section of the dual mode headphone of FIG. 1 in accordance with one aspect of the present application.
Figure 3:
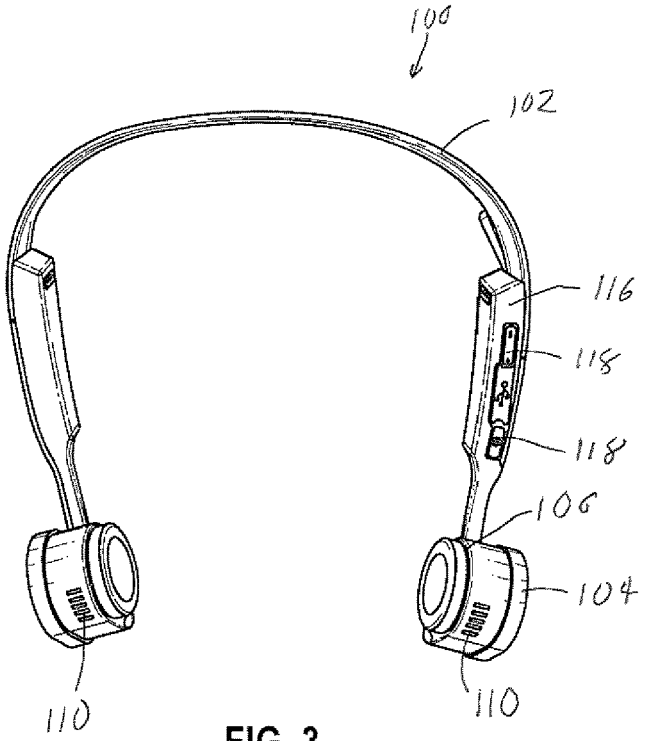
FIG. 3 is a front view of the dual mode headphone of FIG. 1 in accordance with one aspect of the present application.
Figure 4:
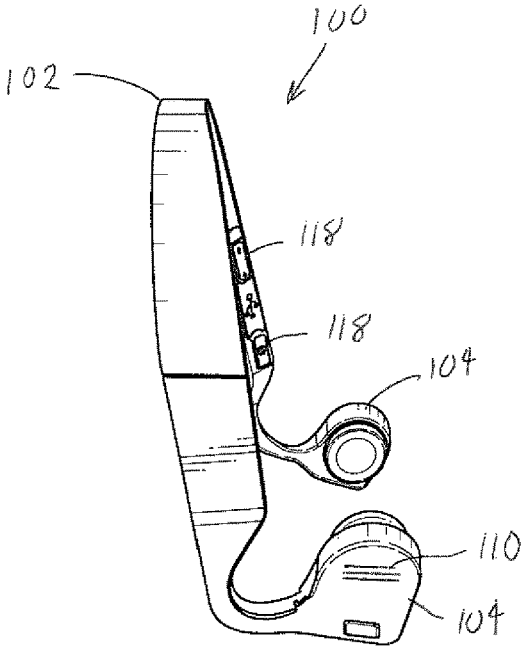
FIG. 4 is a first side view of the dual mode headphone of FIG. 1 in accordance with one aspect of the present application.
Figure 5:
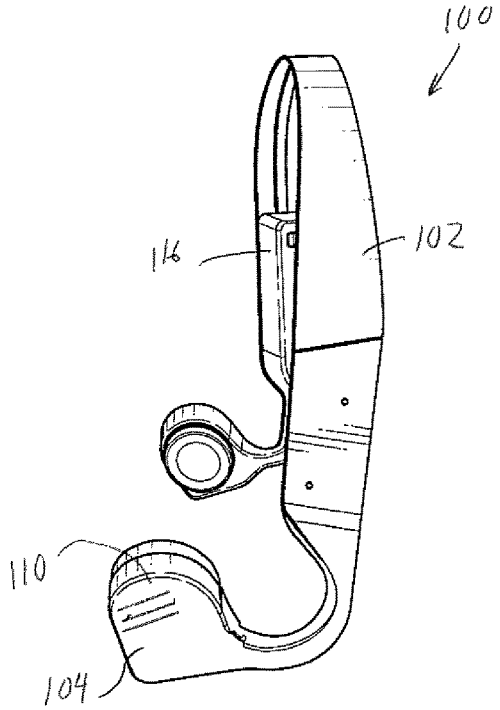
FIG. 5 is a second side view of the dual mode headphone of FIG. 1 in accordance with one aspect of the present application.
Figure 6:
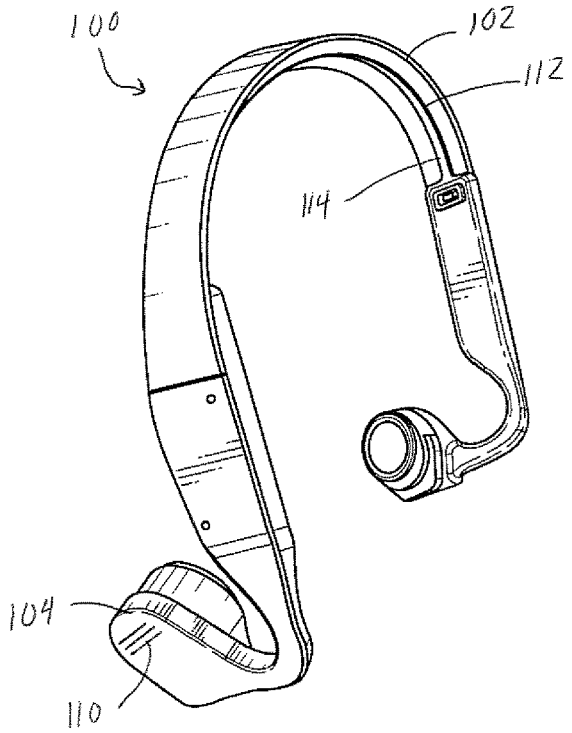
FIG. 6 is another perspective view of the dual mode headphone of FIG. 1 in accordance with one aspect of the present application.

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

The present disclosure relates to a wireless headphone having a dual-output acoustic transducer module. The dual-output acoustic transducer module may combine an audio speaker with a piezoelectric bone-conductive transducer. This may allow a user to use the wireless headphones in a dual mode wherein the dual-output acoustic transducer module may be worn over the ears to allow the sound waves to be transmitted through a speaker to the ear drum, or anywhere on the skull for bone conductive transmission of sound waves through bones in the user's skull.

Referring now to the FIGS. 1-8, a dual mode wireless headphone 100 may be seen. The dual mode wireless headphone 100 may be worn over the ears to allow the sound waves to be transmitted to the ear drum, or anywhere on the skull for bone conductive transmission of sound waves through bones in the user's skull.

The dual mode headphone 100 may have a band 102. The band 102 may be used to secure the dual mode wireless headphone 100 on a head and/or neck of a user. The band 102 may be semi-rigid. This may allow the band 102 to conform to a shape and size of the head and/or neck of the user. In the embodiment shown in the FIGS. 1-8, the band 102 may be "U" shaped. However, this is shown as one example and should not be seen in a limiting manner. For example, the band 102 may be similar to an eyeglass frame having stems which engage and contact the side of the user's head. The band 102 may also be clips which attach to the ears of the user.

Located on opposing ends of the band 102 may be a housing 104. The housing 104 may be formed of different geometrical configurations. In the present embodiment, the housing 104 may be tubular in shape. However, this is shown as an example and should not be seen in a limiting manner.

The housing 104 may be an enclosure having an open section 106. The open section 106 may be covered by a meshing 108. In accordance with one embodiment, the meshing 108 may be a foam meshing. A foam meshing may allow for the housing 104 to more comfortably sit on the ears and/or skull of the user.

The housing 104 may be used to store and hold a dual-output acoustic module 202 (FIGS. 9-10) forming a part of a dual mode headphone circuit 200. In accordance with one embodiment, the housing 104 may have a plurality of openings 110. In the embodiment shown, the openings 110 may be formed in a side of the housing 104. The openings 110 may also be formed on an exterior side 102B of the band 102. The openings 110 may allow air flow through the housing 104. The above are only shown as examples and should not be seen in a limiting manner. The openings 110 may be formed in other areas without departing from the spirit and scope of the present invention.

Each dual-output module 202 may be coupled together by wiring 112. The wiring 112 may be secured within a channel 114 formed within an interior section 102A of the band 102.

A second housing 116 may be formed and positioned above one of the housing 104. The second housing may be used to store and hold the other components of the dual mode headphone circuit 200 (FIG. 6) which may be described below. The second housing 116 may have control buttons 118. The control buttons 118 may be used to control operation of the dual mode headphone circuit 200.

Figure 9:
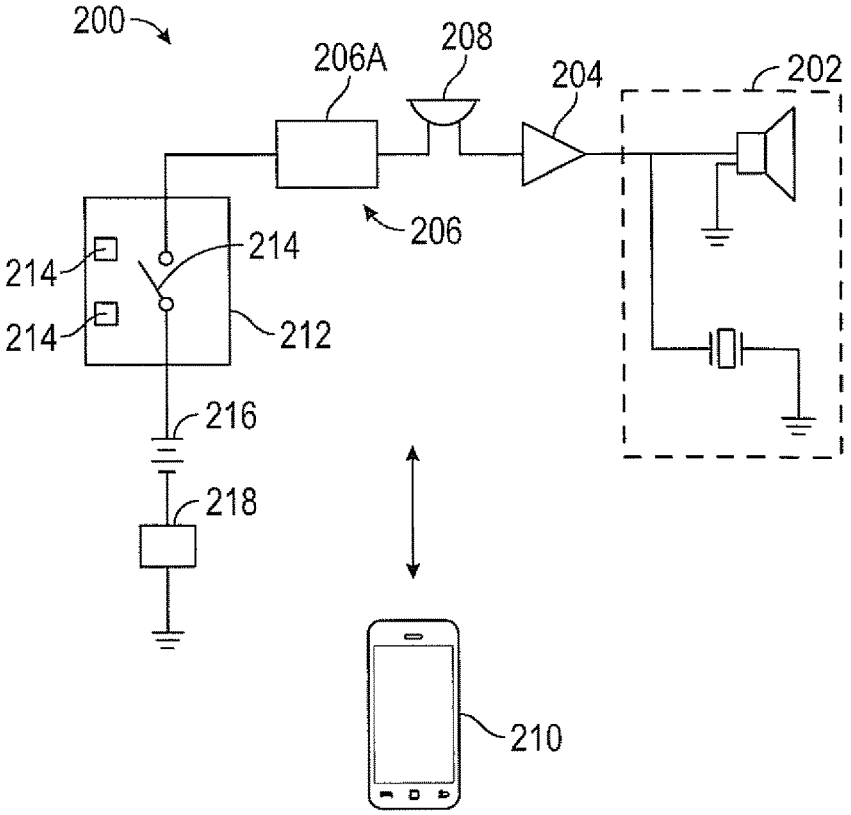
FIG. 9 is a block diagram of a dual mode headphone circuit used in the dual mode headphone of FIG. 1 in accordance with one aspect of the present application.
Figure 10:
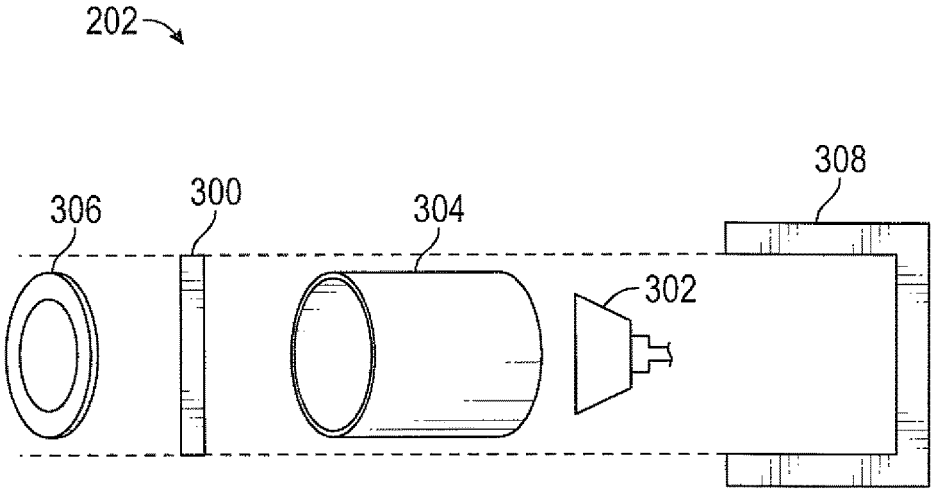
FIG. 10 is an exploded perspective view of a dual-output acoustic transducer module used in the dual mode headphone in accordance with one aspect of the present application.

Referring to FIG. 9, the dual mode headphone circuit 200 may be shown. The dual mode headphone circuit 200. The dual mode headphone circuit 200 may have a dual-output acoustic transducer module 202. The dual-output acoustic transducer module 202 may allow sound waves to be transmitted to the ear drum, or use bone conductive transmission to transmit the sound waves through bones in the user's skull.

An amplifier 204 may be coupled to the dual-output acoustic transducer module 202. The amplifier 204 may be used to control the signal strength being sent to the dual-output acoustic transducer module 202. The amplifier 204 may also filter out noise in the signal being received by the amplifier 204.

The dual mode headphone circuit 200 may have a receiver 206. The receiver 206 may be coupled to the amplifier 204. The receiver 206 may be used to receive radio waves from an electronic device 210 such as a portable music player, smart phone or the like. The electronic device 210 may transmit radio signals which may be received by the receiver 206 and sent to the dual-output acoustic module 202 via the amplifier 204. For example, the electronic device 210 may play music which may be transmitted to the receiver 206 so that a user may listen to the music via the dual mode headphone 100. In accordance with one embodiment, the receiver 206 may be a Bluetooth receiver.

In accordance with one embodiment, the receiver 206 may be a transmitter/receiver 206A. The transmitter/receiver 206A may be used so that signals may be sent to and from the dual mode headphone circuit 200 and the electronic device 210. Thus, this may allow the dual mode headphone circuit 200 to receive signals such as music from the electronic device 210 as well as transmit signals such as control signals back to the electronic device 210. The control signals may be used to control operation of the electronic device such as controlling which songs are being played, pause the music, as well as other functions. In accordance with one embodiment, the transmitter/receiver 206A may be a Bluetooth receiver.

The dual mode headphone circuit 200 may have a microphone 208. The microphone 208. The microphone 208 may convert sound waves into electrical signals. In the present embodiment, the microphone 208 may be coupled to the amplifier 204. If the microphone 208 is working in conjunction with the electronic device 210, the microphone 206 may need to transmit signals to the electronic device 210. In accordance with one embodiment, the microphone 208 may be a Bluetooth microphone. The Bluetooth microphone may work with the electronic device 210 to transmit radio waves between the microphone 206 and the electronic device 210 such as a smart phone. Alternatively, the microphone 208 may work with transmitter/receiver 206A to transmit signals to the electronic device 210.

The dual mode headphone circuit 200 may have a control panel 212. The control panel 212 having control devices 214. The control devices 214 may be buttons, switches or similar devices to control operation of the dual mode headphone circuit 200. For example, the control device 214 may be an ON/OFF switch, a volume control mechanism, a selection switch for determining a mode of operation (sound waves to be transmitted to the ear drum, bone conductive transmission through bones in the user's skull and/or both).

The dual mode headphone circuit 200 may be powered by a power source 216. The power source 216 may be a DC power supply such as a battery. In accordance with one embodiment, the power supply 216 may be a rechargeable battery. If a rechargeable battery is used, the dual mode headphone circuit 200 may have a charging port 218. The charging port may allow a user to connect the dual mode headphone circuit 200 to a charging source. In accordance with one embodiment, the charging port 218 may be a Universal Serial Bus (USB) charging port.

The dual-output acoustic transducer module 202 may be comprised of a plurality of components. As may be seen in FIG. 9 may have piezoelectric transducer 300. The piezoelectric transducer 300 may convert electric signals into mechanical vibrations in order to sends sound to the inner ear through the cranial bones. A loudspeaker 302 may be coupled to the piezoelectric transducer 300. The loudspeaker 302 may include a speaker and driver housed within an enclosure. The loudspeaker 302 may be any type of loudspeaker 302 used for headphone applications.

The piezoelectric transducer 300 may be coupled to the loudspeaker 302 through a connector tube 304. In general, the loudspeaker 302 may be positioned behind the piezoelectric transducer 300.

A convex escutcheon plate 306 may be coupled to the piezoelectric transducer 300 and positioned over the connector tube 306. The escutcheon plate 306 may be fitted to cover the dual-output acoustic transducer module 202. The escutcheon plate 306 may have a plurality of vent holes for comfort and seamless fitting to the skin.

The dual-output acoustic transducer module 202 may be encapsulated by a material 308. In accordance with one embodiment, the material 308 may be a soft polymer material. By encapsulating the module, the module is sealed and isolated from the surrounding. Thus, there is minimal to no sound leakage from the side and back of the module. The encapsulation of the module also serves as a resonating chamber to improve the sound wave delivered. Concentric stepping groves may be incorporated on the inside of the enclosure so as to minimize sound wave emission via the exterior of the enclosure.

Figure 7:
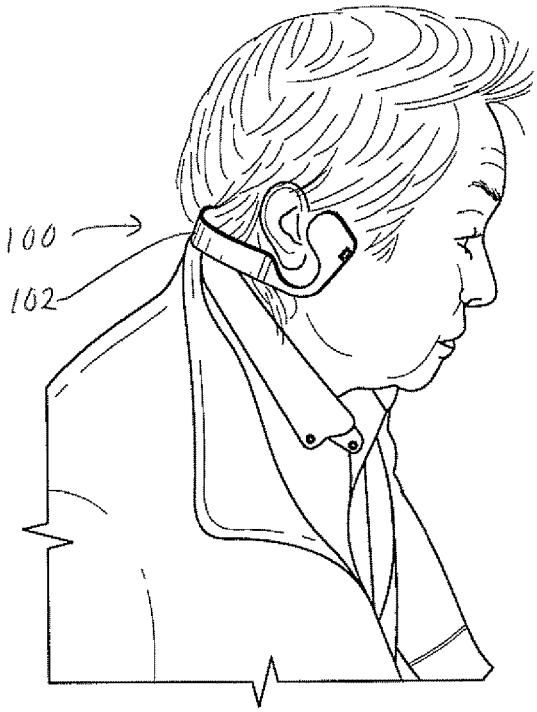
FIG. 7 is a side view of the dual mode headphone being used in accordance with one aspect of the present application.
Figure 8:
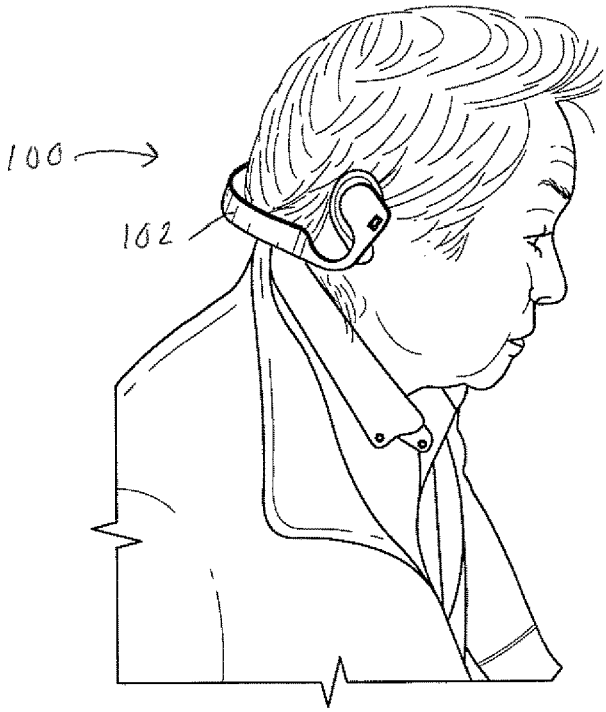
FIG. 8 is a side view of the dual mode headphone being used in accordance with one aspect of the present application.

In operation, the user may use the control devices 214 to select a mode of operation for the dual mode headphone 100. The user may select for either the loudspeaker 302, the piezoelectric transducer 300 and/or both the loudspeaker 302 and the piezoelectric transducer 300 to be operational. Based on the mode of operation selected, the user may position the dual mode headphone 100 so that the housing 104 is positioned within the ears of the user as shown in FIG. 8 or on the skull of the user as shown in FIG. 7.

In accordance with one embodiment, audible control of the piezoelectric transducer 300 and/or the loudspeaker 302 maybe done wirelessly through a smart phone application. For example, volume, balance, equalizer as well as other audible controls may be embedded and controlled through a smart phone application.

The advantages of this module include, without limitation, is that it provides seamless connection between the transducer module 202 and the skull. The dual mode headphone 100 can be worn over the ears, or anywhere on the skull. It allows the user to select both loudspeaker 302 and piezoelectric transducer 300, or either mode. For music lovers, the dual mode headphone 100 offers high-fidelity full spectrum audio waves without overwhelming dB that damages the inner ear. For the hearing impaired, this offers an affordable and comfortable alternative to expensive prescription hearing aids. Bone conductive mode can be selected when the user desires privacy and do not want any "leakage" of the audio signals from the loudspeaker.

While embodiments of the disclosure have been described in terms of various specific embodiments, those skilled in the art will recognize that the embodiments of the disclosure may be practiced with modifications within the spirit and scope of the claims

The invention claimed is:

1. A dual mode headphone comprising:

a band positioning the dual mode headphone on one of a head or neck of a user;

a pair of first housings, wherein one of the first housings is formed on each end of the band;

a dual mode headphone circuit having a dual-output acoustic transducer module positioned in each of the pair of first housings, the dual-output acoustic transducer module allowing for both air conduction, and bone conduction of sound waves, wherein the dual-output acoustic transducer module comprises:

a piezoelectric transducer;

a loudspeaker;

a connector tube positioned between the piezoelectric transducer and the loudspeaker; and an escutcheon plate coupled to the piezoelectric transducer and positioned over the connector tube, wherein the escutcheon plate has a plurality of vent holes.

2. The dual mode headphone of claim 1, wherein the loudspeaker is positioned behind the piezoelectric transducer.

3. The dual mode headphone of claim 1, wherein the dual-output acoustic transducer module comprises an encapsulation material covering the dual-output acoustic transducer module.

4. The dual mode headphone of claim 3, wherein the encapsulation material is a soft polymer material.

5. The dual mode headphone of claim 1, wherein the dual mode headphone circuit comprises a microphone coupled to the dual-output acoustic transducer module.

6. The dual mode headphone of claim 1, wherein the dual mode headphone circuit comprises a microphone coupled to the dual-output acoustic transducer module, the microphone being a Bluetooth microphone.

7. The dual mode headphone of claim 1, wherein the dual mode headphone circuit comprises:

an amplifier coupled to the dual-output acoustic transducer module;

a microphone coupled to the amplifier;

a transmitter/receiver coupled to the amplifier; and a control unit coupled to the dual-output acoustic transducer module.

8. The dual mode headphone of claim 7, wherein the dual mode headphone circuit comprises a power source powering the dual mode headphone circuit.

9. The dual mode headphone of claim 8, wherein the dual mode headphone circuit comprises a charging port coupled to the power source.

* * * * *